United States Patent [19]

Sussman

[11] Patent Number: 4,589,430

[45] Date of Patent: May 20, 1986

[54] COSMETIC KIT WITH REPLACEABLE HOLDERS

[75] Inventor: Morris Sussman, Freeport, N.Y.

[73] Assignee: Shore Plastics, Inc., Freeport, N.Y.

[21] Appl. No.: 595,685

[22] Filed: Apr. 2, 1984

[51] Int. Cl.[4] ..... A45D 33/00

[52] U.S. Cl. ..... 132/82 D; 132/83 R

[58] Field of Search ..... 132/82 R, 82 B, 82 C, 132/82 D, 82 H, 82 J

[56] References Cited

U.S. PATENT DOCUMENTS

| | | | |
|---|---|---|---|
| 1,774,543 | 9/1930 | Babbitt | 132/82 D |
| 2,196,017 | 4/1940 | Kane | 132/82 D |
| 2,314,717 | 3/1943 | Landwehr | 132/82 D |
| 3,441,033 | 4/1969 | Flax | 132/82 R |
| 3,559,854 | 2/1971 | Loveland | 132/82 R |
| 3,637,278 | 1/1972 | Easterbrooks | 132/83 R |
| 4,421,127 | 12/1983 | Geer | 132/83 R |
| 4,483,355 | 11/1984 | Yuhara | 132/83 R |
| 4,526,273 | 7/1985 | Tsuji et al. | 132/82 D |

*Primary Examiner*—Gene Mancene

*Assistant Examiner*—Carolyn A. Harrison

*Attorney, Agent, or Firm*—Michael Ebert

[57] ABSTRACT

A make up kit for storing an assortment of different cosmetics and applicators therefor in a highly compact case having a hinged cover. Nested in the case is a rectangular tray divided by a ridge into a front compartment for accommodating the applicators and a rear compartment for receiving a row of replaceable holders each carrying a supply of a different cosmetic such as pressed powder or mascara. The holders are dimensioned to snap into the rear compartment and to fit snugly between the ridge and the rear wall of the tray. Formed on the rear end of each holder is a tongue which projects from the base and is socketed within a complementary slot in the rear wall of the tray. The top of the holder includes a projecting front ledge which overlies the ridge to define a thumb piece to facilitate removal of the holder from its compartment. Below the ledge on the front end of the holder is a detent which engages the side of the ridge to retain the holder in place.

6 Claims, 8 Drawing Figures

COSMETIC KIT WITH REPLACEABLE HOLDERS

BACKGROUND OF INVENTION

1. Field of Invention

This invention relates generally to cases for cosmetics and applicators therefor, and more particularly to a highly compact and well organized make up kit.

In the sense this term is used in the field of cosmetics, make up takes in the various cosmetics employed to color and beautify the face. Included, therefore, in make up are lipstick, blusher, eyelash mascara and eye shadow, as well as pressed powders. In order to apply these cosmetics, various tools or applicators are required, such as brushes and pencils.

Because of the assortment of cosmetic items required by the modern woman to do justice to her make up, at home these items are usually deployed on a mirrored dressing table. But when away from home, the same woman tries to take along the various items she needs for proper make up, using her hand bag as a carry all.

This presents a practical problem; for in the typical handbag, one finds scattered therein various small compacts, cosmetic containers of various sorts and cosmetic applicators. The same handbag may also contain a handkerchief, a change purse, a wallet and other non-cosmetic items.

While some women take pains or organize the contents of their handbag so as to make the various items therein readily accessible on demand, more typically the items are in a jumble, and when a woman wishes to make up, say, in a restaurant or club restroom, or elsewhere away from home, she has difficulty in extracting from her handbag the cosmetic items necessary for make up. Some women cope with this problem by taking along only a very limited number of basic cosmetic items, but this is not a satisfactory solution; for then the make up is deficient and the woman is not at her best.

While attempts have heretofore been made to provide a compact, multi-cellular make up kit, each cell of which contains a particular cosmetic item such as blusher or mascara, this kit has only a short term utility; for when a given item is exhausted, it cannot be replenished. Since in the course of making up on a given occasion with an assortment of cosmetic items, one does not use the same amount of each item in the multi-cellular kit, some items last much longer than others. As a consequence, a point is reached with a kit of this type where there is no more mascara, or where a little blusher is left, yet there is a plentiful supply of other items.

Thus, make up kits of the type heretofore known work best when they are fresh; but with continued use, the supply of certain essential cosmetic items becomes exhausted, and the user of the kit then has to carry along separate compacts to substitute for the exhausted items. One attempt to overcome this problem is disclosed in U.S. Pat. No. 4,421,127 of Geer.

SUMMARY OF INVENTION

In view of the foregoing, the main object of this invention is to provide a make up kit for storing an assortment of different cosmetics and applicators therefor necessary for proper make up, each cosmetic being contained in a replaceable holder so that when the supply is exhausted, the holder may be replaced with a fresh holder.

Thus an advantage of a make up kit in accordance with the invention is that it may be used indefinitely; for the effective life of the kit does not depend on how long the supply of a given cosmetic lasts—for once this supply is exhausted, it may be replenished.

More particularly, an object of this invention is to provide a kit of the above type in which the various cosmetics necessary for make up are contained in a row of replaceable holders latched into one compartment and applicators therefor in an adjacent compartment, so that the user of the kit can conveniently select an appropriate cosmetic and apply it as she observes her face in the mirror on the hinged cover of the case.

Also an object of the invention is to provide a make up kit in which all components thereof, other than the mirror, are formed of molded synthetic plastic material whereby the kit may be mass produced at relatively low cost.

Briefly stated, these objects are attained in a make up kit for storing an assortment of different cosmetics and applicators therefor in a highly compact case having a hinged cover. Nested in the case is a rectangular tray divided by a ridge into a front compartment for accommodating the applicators and a rear compartment for receiving a row of replaceable holders each carrying a supply of a different cosmetic such as pressed powder or mascara. The holders are dimensioned to snap into the rear compartment and to fit snugly between the ridge and the rear wall of the tray. Formed on the rear end of each holder is a tongue which projects from the base and is socketed within a complementary slot in the rear wall of the tray. The top of the holder includes a projecting front ledge which overlies the ridge to define a thumb piece to facilitate removal of the holder from its compartment. Below the ledge on the front end of the holder is a detent which engages the side of the ridge to retain the holder in place.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
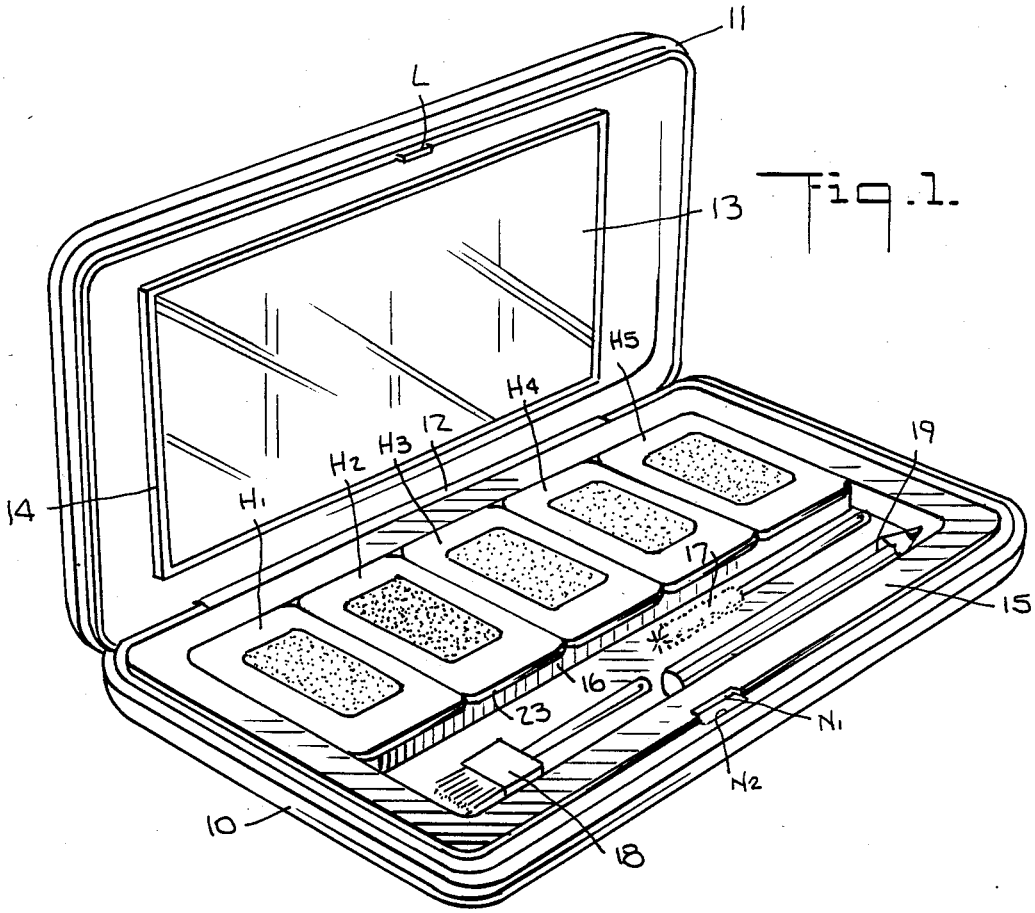
FIG. 1 illustrates in perspective view a make up kit in accordance with the invention, the kit being shown with its hinged cover open.
Figure 2:
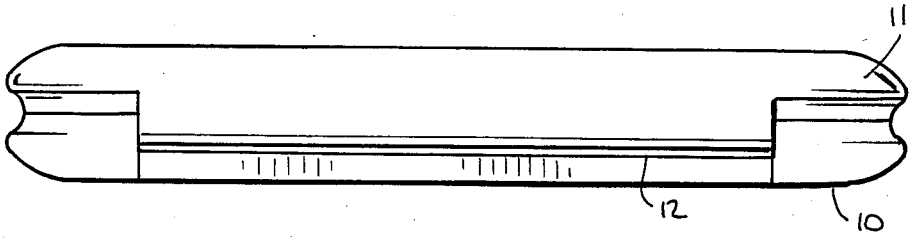
FIG. 2 is a rear view of the closed kit.

Referring now to FIGS. 1 and 2, there is shown a compact make up kit in accordance with the invention, the kit including a rectangular case 10 having a cover 11 hinged to the rear wall thereof by an elongated hinge 12. A mirror 13 is fitted into a frame 14 formed on the inner surface of the cover, the mirror being bonded thereto.

Nested within case 10 is a shallow tray 15 having a peripheral flange on whose front side is a notch $N_1$ which complements a notch $N_2$ formed in the front wall of the case to define a slot for receiving a flexible latch piece L projecting from the front wall of the cover. The latch piece serves to hold the cover in its closed position.

Figure 3:
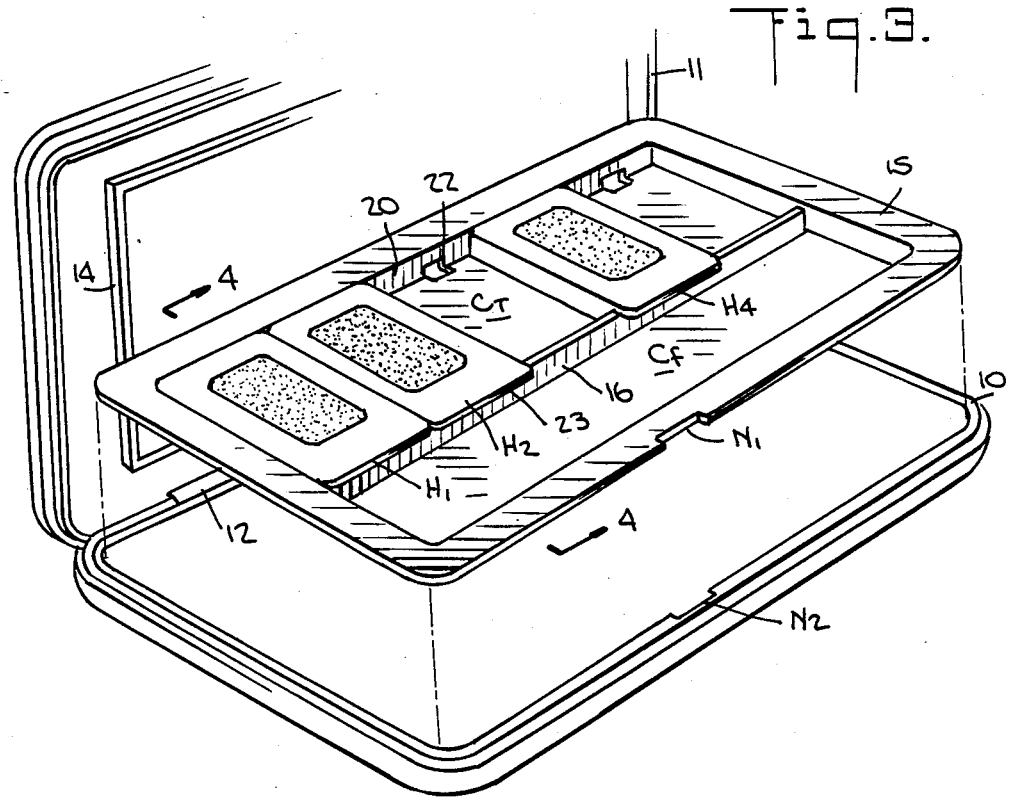
FIG. 3 illustrates the tray component of the kit.

Tray 15, as best seen in FIG. 3, is provided with a longitudinal ridge 16 which divides the tray into a rear compartment $C_r$ and a parallel front compartment $C_f$. The front compartment $C_f$ serves to accommodate various cosmetic applicators, such as a wire brush 17 for mascara, a blusher brush 18 and an eye outline pencil 19, the choice of applicators depending on the cosmetics supplied with the kit.

Received in rear compartment $C_r$ is a row of replaceable miniature holders $H_1$ to $H_5$, each containing a supply of a different cosmetic, such as pressed powder, blusher, lip gloss, mascara, etc. Each holder has a rectangular form and is dimensioned to snap into the rear compartment and to fit snugly therein between the ridge 16 and the rear wall 20 of the tray 15.

Figure 8:
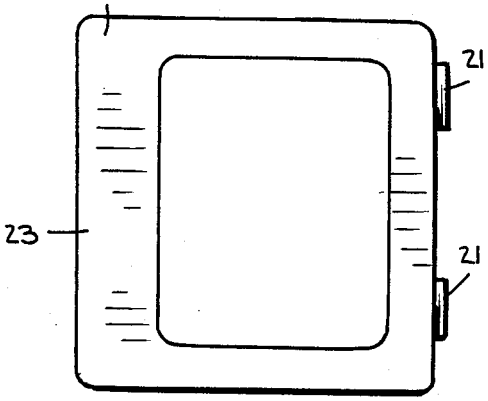
FIG. 8 is a top view of a double-size holder.

In FIG. 1, the row is composed of five identical holders. However, in practice, in order to provide a larger supply of a given cosmetic such as pressed powder, the holder therefor may take the form of the holder $H_6$ shown in FIG. 8 where the width of the holder is double the normal width. Thus should holder $H_6$ be used in the kit, there would then be room for only three normal size holders.

Figure 4:
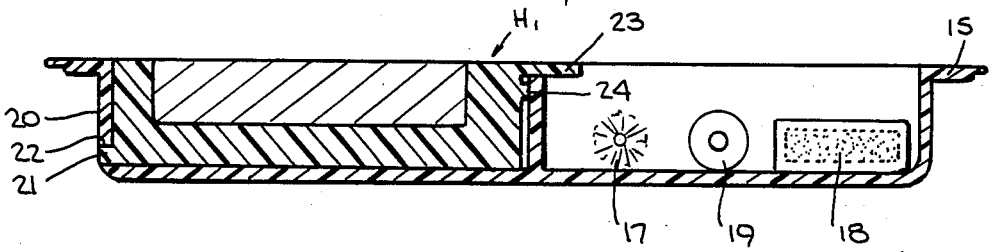
FIG. 4 is a transverse section taken through the plane indicated by lines 4—4 in FIG. 3.
Figure 5:
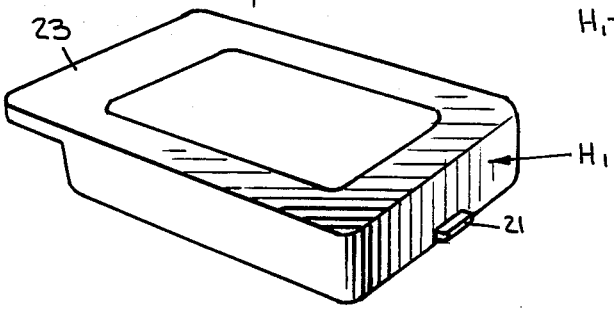
FIG. 5 is a perspective view of one holder.
Figure 6:
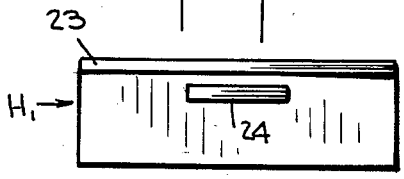
FIG. 6 is a front view of the holder.
Figure 7:
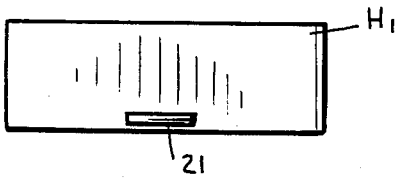
FIG. 7 is a rear view of the holder.

As shown in FIG. 4 in connection with holder $H_1$, each holder includes a rear end tongue 21 projecting from the base of the holder. When the holder is snapped into the rear compartment, tongue 21 is socketed in a slot 22 formed at a corresponding position in the rear wall 20 of the tray.

The holder is also provided with a ledge 23 which projects forwardly from the top surface thereof and overlies the ridge 16. This ledge forms a thumb piece making it possible to withdraw the holder from the rear compartment. Below ledge 23 on the front end of the holder is a small detent 24 which engages the side of ridge 16 to retain the holder in the rear compartment.

Thus each holder may be snapped into the rear compartment or withdrawn therefrom when the cosmetic supply is exhausted and the holder has to be replaced with a fresh supply. The holders, as well as the case components, are preferably molded of synthetic plastic material of good structural strength, such as polypropylene. The cosmetic supply which is seated within the holder cavity may be contained within a small godet which is pressed into the cavity, or the cosmetic supply may be placed directly into the cavity.

While there has been shown and described a preferred embodiment of a cosmetic kit with replaceable holders, it will be appreciated that many changes and modifications may be made therein without, however, departing from the essential spirit thereof. Thus while in the kit shown, there is only room for five normal-sized holders (i.e., one inch in width, $1\frac{1}{4}$ inches in length, $\frac{3}{8}$ inch in depth), in practice the case may be made larger to accommodate a greater number of holders and applicators. In addition to polypropylene to fabricate the cosmetic kit, one could also use polystyrene, ABS, SAN and other synthetic plastic materials. And while the compact kit has been described as useful to women, it may be used to house products useful to men.

I claim:

1. A make up kit for storing an assortment of different cosmetics and applicators therefor, said kit comprising:

A. a rectangular case having a hinged cover;

B. a tray nested in the case and divided by a longitudinal ridge into a front compartment for accommodating the applicators and a rear compartment for receiving a row of replaceable miniature holders, each carrying a supply of a different cosmetic;

C. each of said holders having a base, a front end and a rear end, and being dimensioned to snap into the rear compartment and to fit snugly between the ridge and the rear wall of the tray, the holder having a tongue formed on its rear end which projects from the base thereof and is socketed within a complementary slot in the rear wall of the tray, the top of the holder being provided with a forwardly projecting ledge which overlies the ridge and acts as a thumb piece to facilitate withdrawal of the holder from its compartment, and a detent on the front end below said ledge to engage the side of the ridge to retain the holder in the rear compartment.

2. A kit as set forth in claim 1, wherein said cover has a mirror secured to the inner face thereof.

3. A kit as set forth in claim 1, wherein said case, said cover, said tray and said holders are all molded of synthetic plastic material.

4. A kit as set forth in claim 1, wherein said holders have identical dimensions.

5. A kit as set forth in claim 1, wherein at least one of the holders in the row has twice the width of the other holders.

6. A kit as set forth in claim 1, wherein the front wall of the tray and the front wall of the case have complementary notches to define a slot for receiving a latching piece projecting from the cover.

* * * * *